US008201805B1

(12) United States Patent
Cid

(10) Patent No.: US 8,201,805 B1
(45) Date of Patent: Jun. 19, 2012

(54) HYDRAULIC JACK APPARATUS

(76) Inventor: Filiberto Cid, Bloomington, CA (US)

( * ) Notice: Subject to any disclaimer, the term of this patent is extended or adjusted under 35 U.S.C. 154(b) by 967 days.

(21) Appl. No.: 12/129,342

(22) Filed: May 29, 2008

(51) Int. Cl.
*B66F 13/00* (2006.01)

(52) U.S. Cl. ..... 254/2 R; 254/3 C; 254/2 C

(58) Field of Classification Search ..... 254/2 R, 254/3 C, 2 C
See application file for complete search history.

(56) References Cited

U.S. PATENT DOCUMENTS

| | | | | |
|---|---|---|---|---|
| 2,868,501 | A * | 1/1959 | Cloud et al. | 254/93 HP |
| 3,735,958 | A * | 5/1973 | Hollingsworth | 254/2 R |
| 3,796,055 | A | 3/1974 | Mahony | |
| 3,830,470 | A * | 8/1974 | Gibson | 254/133 R |
| 4,599,034 | A * | 7/1986 | Kennedy et al. | 414/678 |
| 4,645,181 | A * | 2/1987 | Schapansky | 254/2 B |
| 4,765,777 | A | 8/1988 | Gregory | |
| 4,925,345 | A | 5/1990 | McCown, Jr. et al. | |
| 5,135,335 | A | 8/1992 | Stephens et al. | |
| D329,728 | S | 9/1992 | Ladek | |
| 5,492,437 | A | 2/1996 | Ortiz | |
| D384,482 | S | 9/1997 | Thole | |
| 5,951,206 | A | 9/1999 | Gregory | |
| 6,142,710 | A | 11/2000 | Holland, Jr. et al. | |
| 6,193,442 | B1 | 2/2001 | May | |
| 7,611,126 | B2 * | 11/2009 | Vesa | 254/93 H |

* cited by examiner

*Primary Examiner* — Lee D Wilson
*Assistant Examiner* — Shantese McDonald

(57) ABSTRACT

A hydraulic jack apparatus includes a platform that has a front side, a back side and a pair of lateral sides. A pair of vertical supports is attached to and extends upwardly from the platform. A horizontal support is attached to the front side and extends forward thereof. A pair of wheels is provided. Each of the vertical supports has one of the wheels rotatably coupled thereto. The wheels have a lowermost edge positioned above a bottom side of the platform. A lift assembly is attached to the platform. The lift assembly is abutted against and lifts a mobile home.

11 Claims, 6 Drawing Sheets

HYDRAULIC JACK APPARATUS

BACKGROUND OF THE INVENTION

Field of the Invention

The present invention relates to trailer home lift devices and more particularly pertains to a new trailer home lift device for lifting trailer homes, also known as mobile homes, so that they can be positioned on a trailer to be moved to another location.

SUMMARY OF THE INVENTION

The present invention meets the needs presented above by generally comprising a platform that has a front side, a back side and a pair of lateral sides. A pair of vertical supports is attached to and extends upwardly from the platform. A horizontal support is attached to the front side and extends forward thereof. A pair of wheels is provided. Each of the vertical supports has one of the wheels rotatably coupled thereto. The wheels have a lowermost edge positioned above a bottom side of the platform. A lift assembly is attached to the platform. The lift assembly is abutted against and lifts a mobile home.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
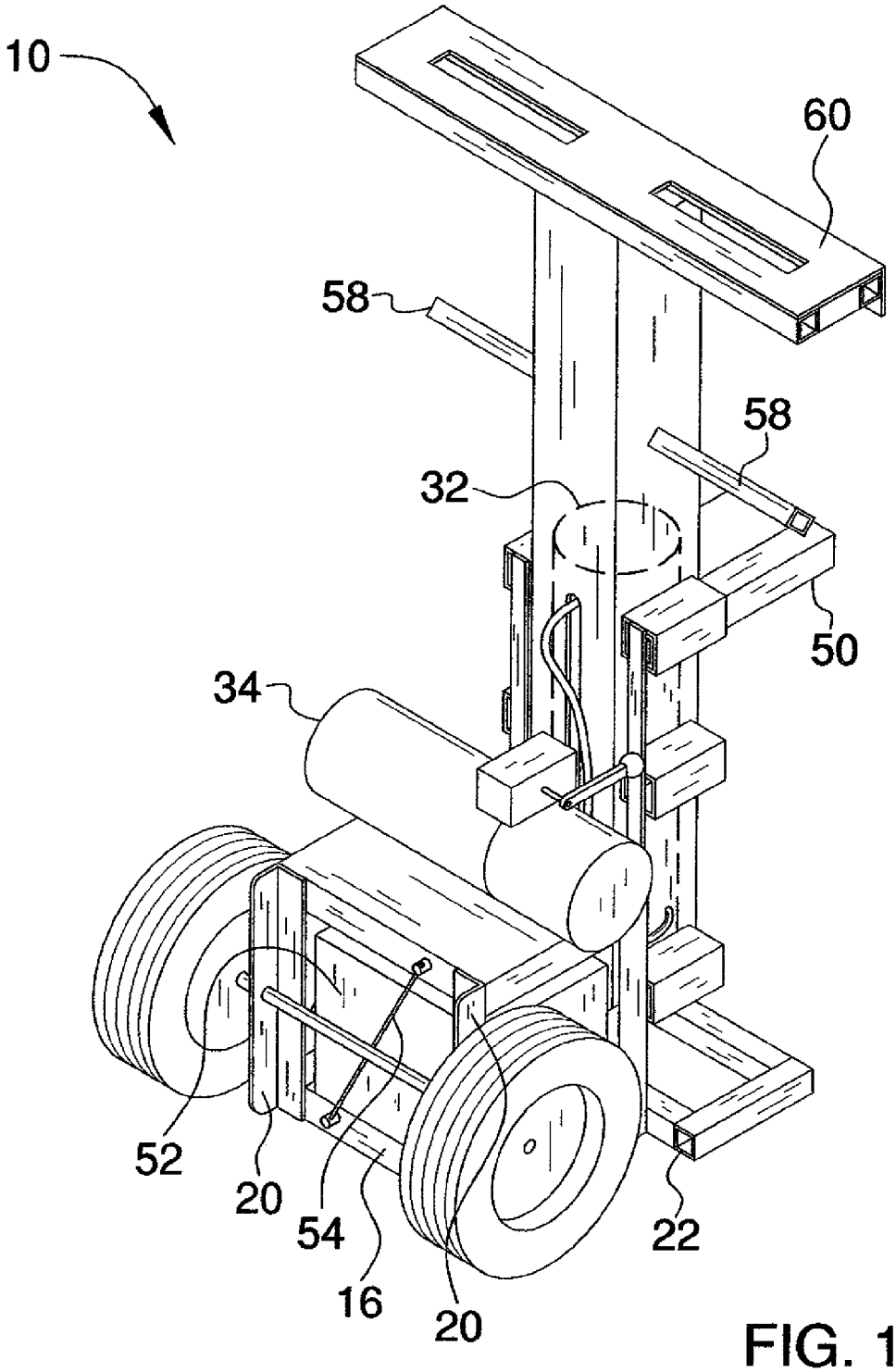
FIG. 1 is a rear perspective view of a hydraulic jack apparatus according to the present invention.
Figure 2:
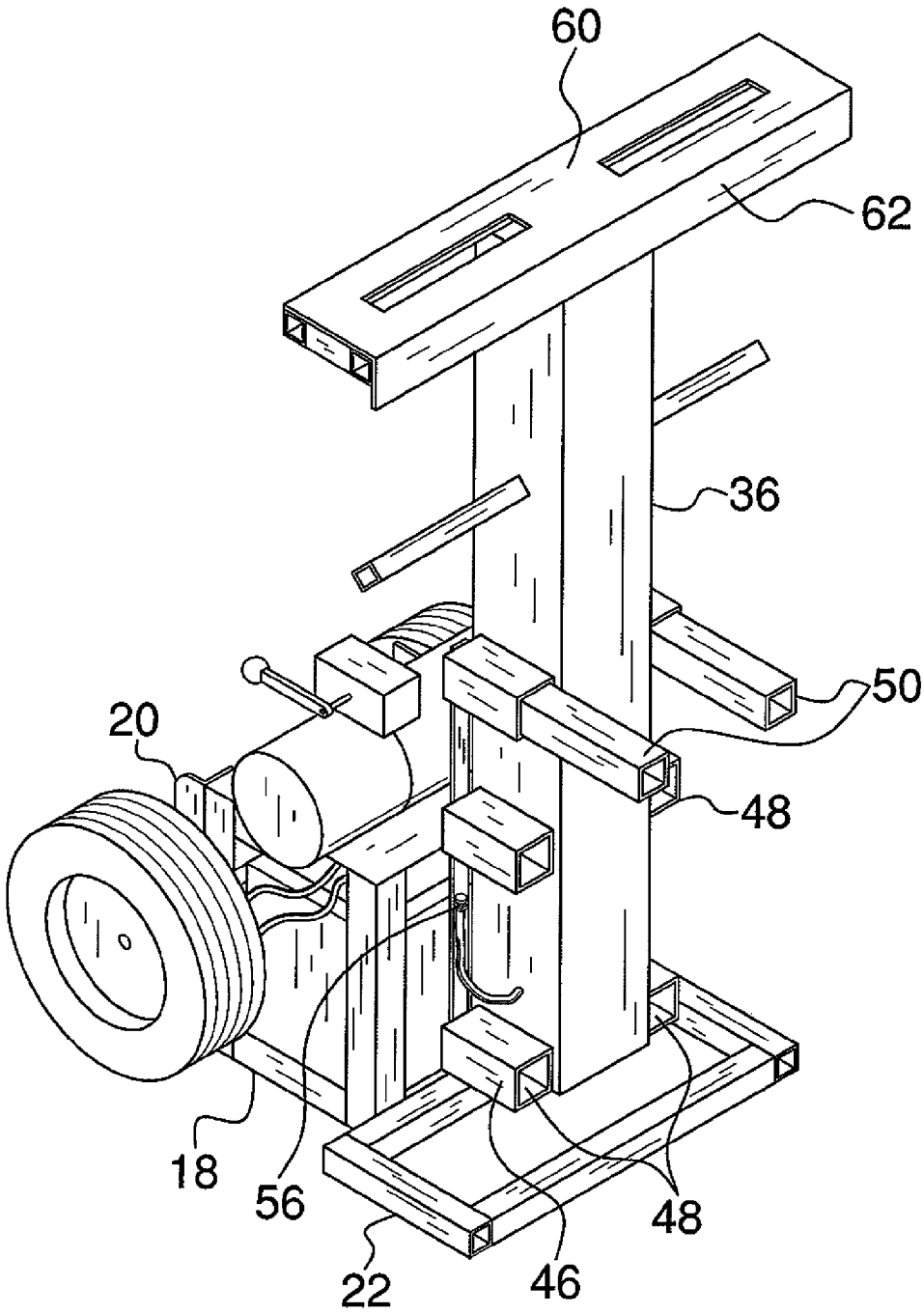
FIG. 2 is a front perspective view of the present invention.
Figure 3:
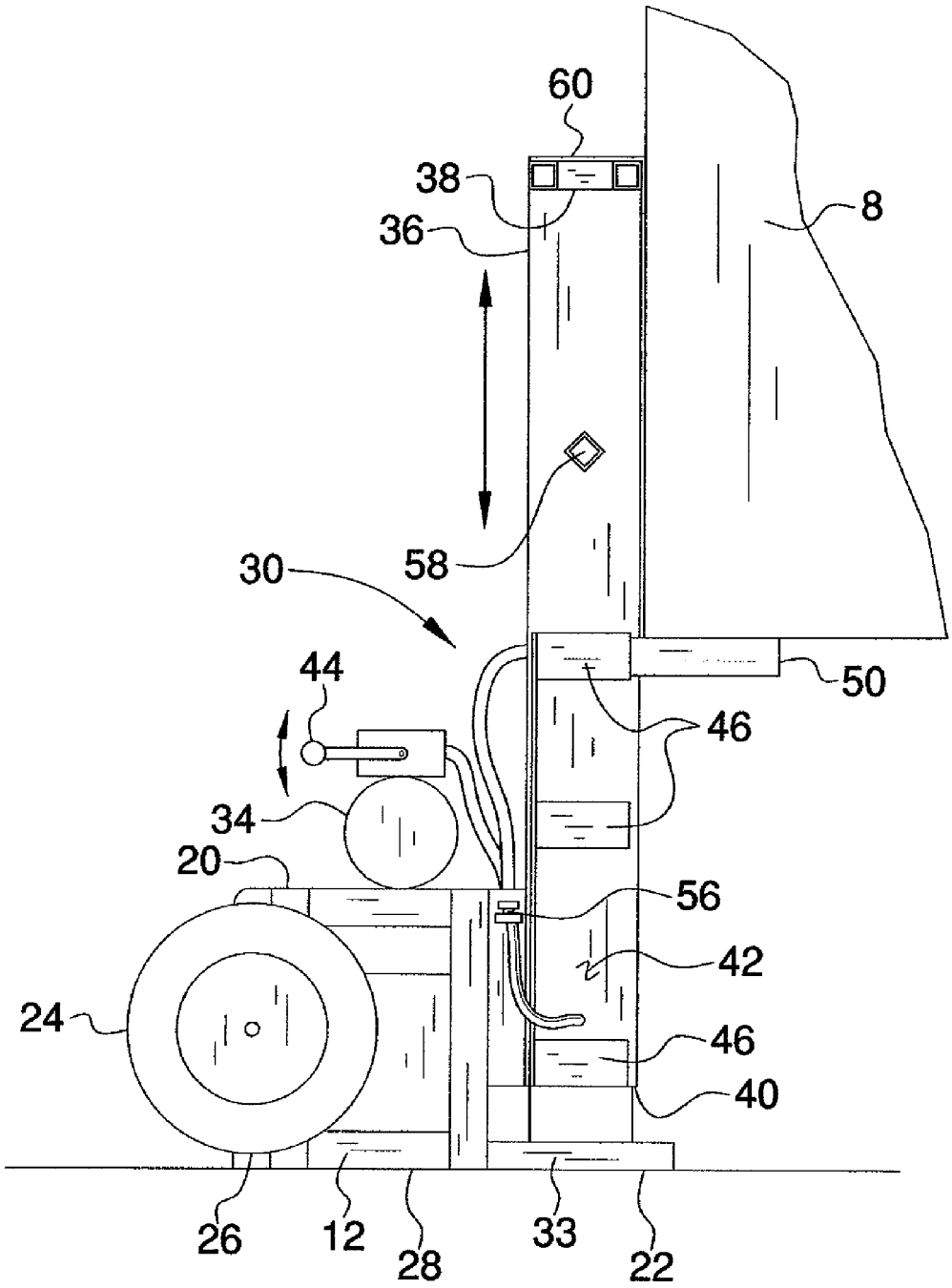
FIG. 3 is a side in-use view of the present invention.
Figure 4:
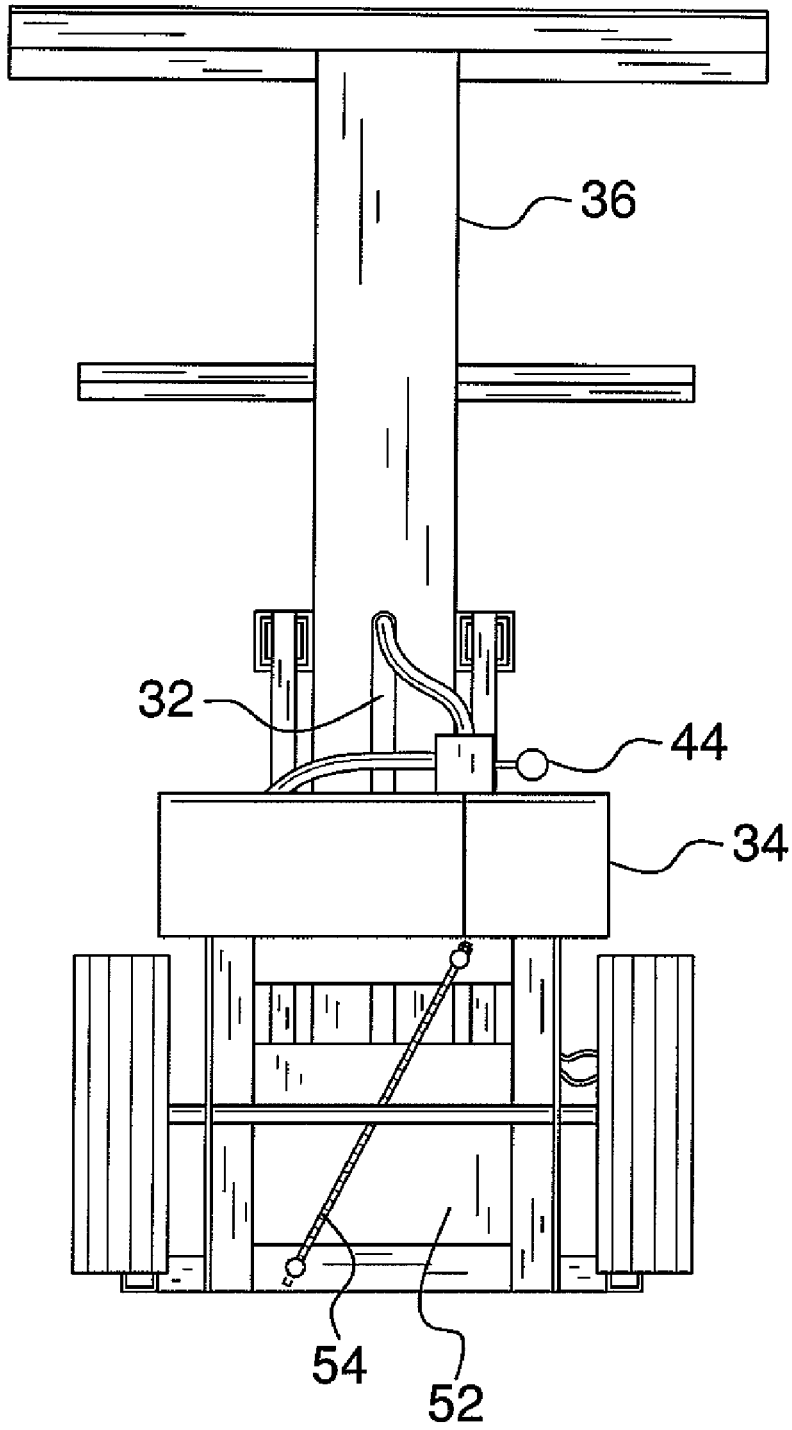
FIG. 4 is a rear view of the present invention.
Figure 5:
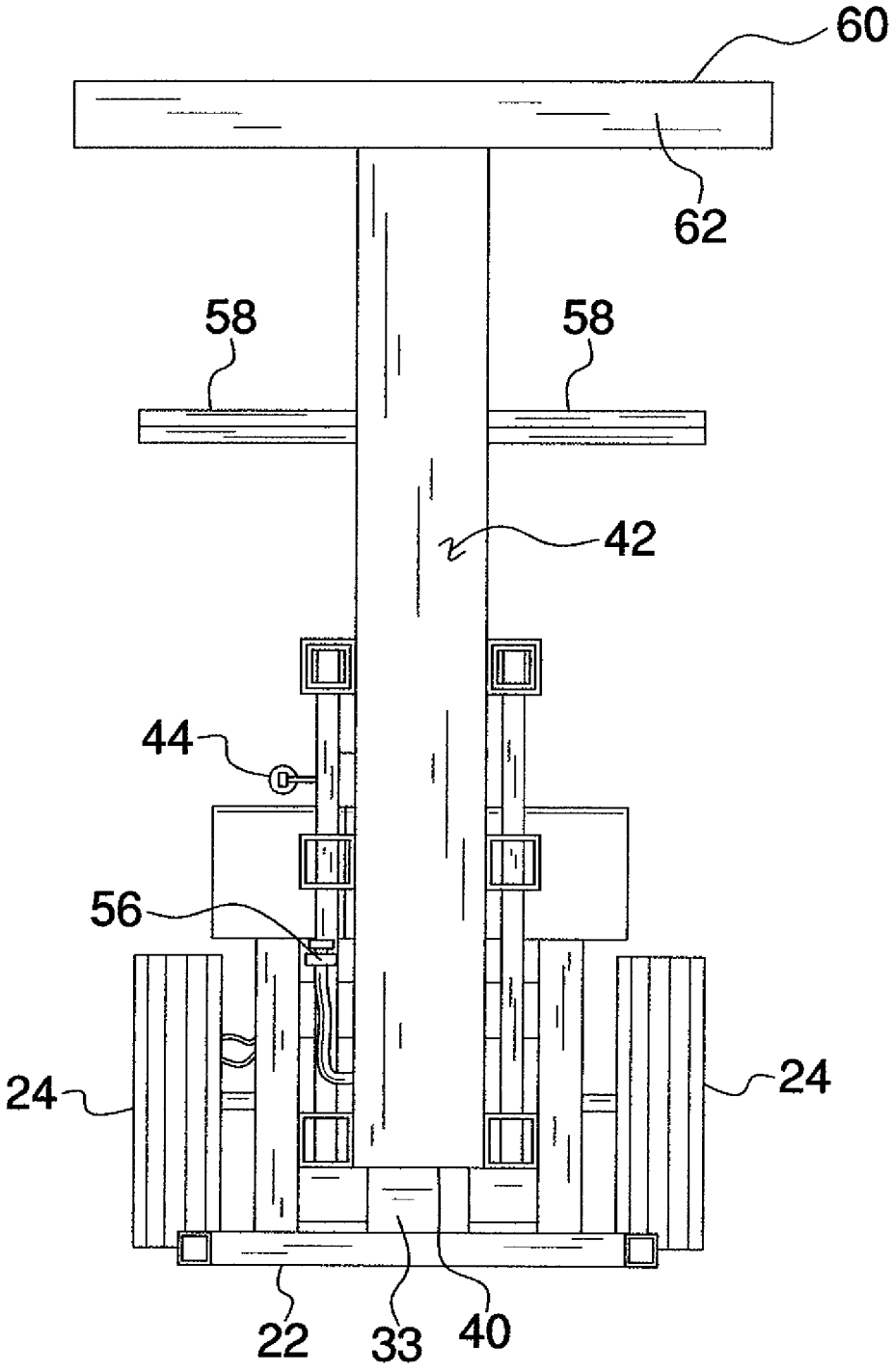
FIG. 5 is a front view of the present invention.
Figure 6:
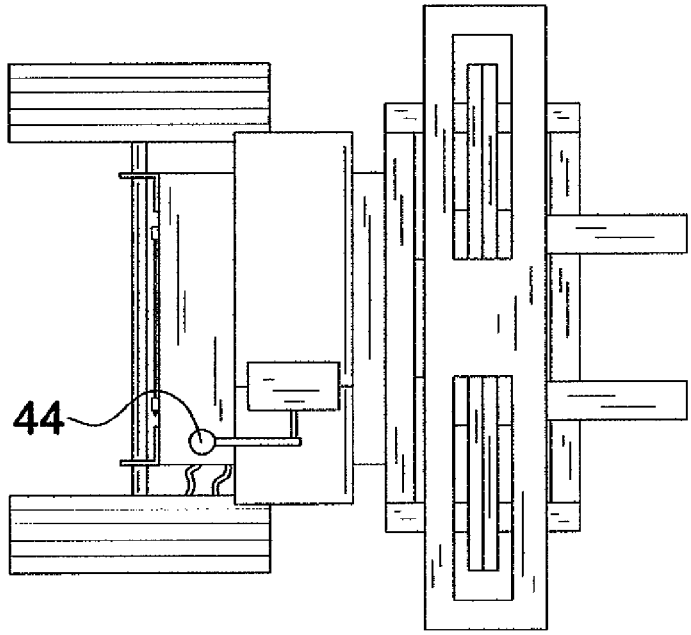
FIG. 6 is a top view of the present invention.
Figure 7:
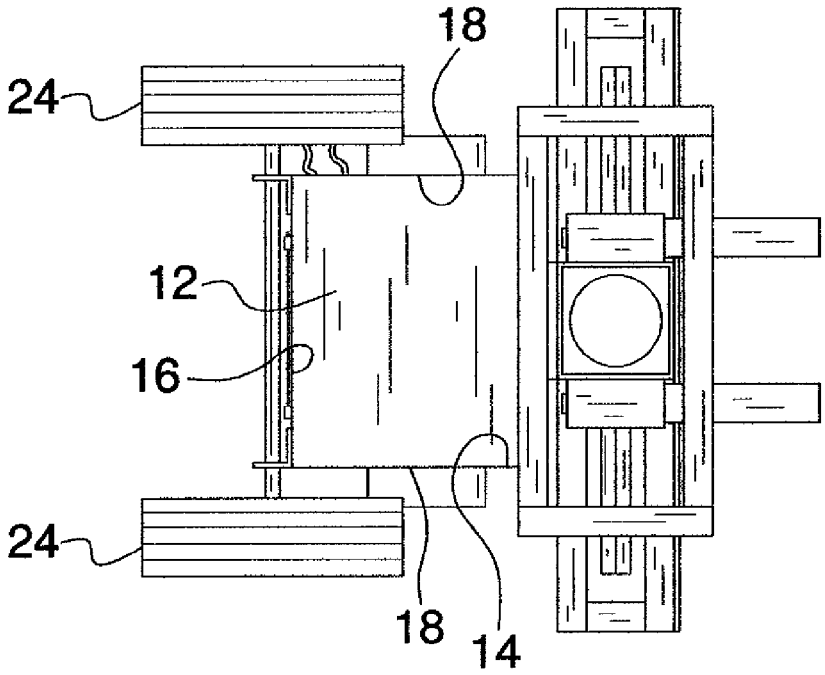
FIG. 7 is a bottom view of the present invention.

With reference now to the drawings, and in particular to FIGS. 1 through 7 thereof, a new trailer home lift device embodying the principles and concepts of the present invention and generally designated by the reference numeral 10 will be described.

As best illustrated in FIGS. 1 through 7, the hydraulic jack apparatus 10 generally comprises a platform 12 that has a front side 14, a back side 16 and a pair of lateral sides 18. A pair of vertical supports 20 is attached to and extends upwardly from the platform 12. A horizontal support 22 is attached to the front side 14 and extends forward thereof. The horizontal support 22 prevents the apparatus 10 from easily tipping over by positioning a support under an object 8 to be lifted.

A pair of wheels 24 is provided. Each of the vertical supports 20 has one of the wheels 24 rotatably coupled thereto. The wheels 24 have a lowermost edge 26 is positioned above a bottom side 28 of the platform 12. The wheels 24 are only abuttable against the ground surface when the platform 12 is tilted back toward the wheels 24. This allows for easy transportation of the platform 12 while preventing the wheels 24 from allowing the platform to move while the apparatus 10 is being used to lift the object 8.

A lift assembly 30 is attached to the platform 12. The lift assembly 30 includes a piston 32 and a pump 34 that are fluidly coupled together. The piston 32 is raised when the pump 34 is activated. The pump 34 preferably is capable of creating pressures at least equal to 2500 psi. A sleeve 36 is attached to the piston 32. The sleeve 36 is raised by the piston 32 when the piston 32 is raised. The sleeve 36 includes a top end 38, a bottom end 40 and a perimeter wall 42 extending between the top 38 and bottom 40 ends. A control 44 is operationally coupled to the pump 34 to raise or lower the piston 32.

A plurality of female receivers 46 is attached to the sleeve 36. The female receivers 46 extend in a direction forward of the platform 12 so that they are positioned over the horizontal support 22. The receivers 46 have an open free end 48 and are vertically spaced from each other. A plurality of rods 50 is provided. Each of the rods 50 is removably extendable into one of the female receivers 46. The plurality of female receivers 46 includes a plurality of pairs of receivers 46 each comprising a pair of horizontally aligned receivers 46 positioned on opposite sides of the sleeve 36. The plurality rods 50 including two rods 50 positioned in the receivers of one the pairs of receivers 46. This forms a stage on which the object 8 may be placed. By vertically aligning the receivers 46, the user of the apparatus 10 can alter the starting height of the rods 50. This is particularly useful where the object 8 will typically be a trailer or a mobile home already lifted off of the ground by its own supports or wheels.

A power supply 52 is electrically coupled to the pump 34. The power supply 52 comprising at least one battery mounted on the platform. A securing member 54 prevents movement of the battery. A release valve 56 is fluidly coupled to the piston 32. The release valve 56 prevents the lowering of the piston 32 until the release valve has been opened by retaining air in a cylinder 33 holding the piston 32. A handle 58 is attached to the sleeve 36. The handle 58 allows a person to grip the apparatus 10 and move it under or away from the object 8 without having to place their hands or any portion of their body under the object 8.

A brace 60 is attached to the top end 38 of the sleeve 36 and is oriented perpendicular to the sleeve 36. The sleeve 36 and brace 60 form a T-shape. The brace 60 has a forward edge 62. The brace 60 assists in preventing the shifting of the object 8 while the object 8 is being lifted or lowered.

In use, the rods 50 are positioned in the receiver 36 and the sleeve 36 and forward edge 62 of the brace 60 are abutted against the mobile home, or other object 8. The mobile home is then lifted by the rods 50 when the rods 50 are raised with the sleeve 36. A transport trailer may then be moved under the mobile home to move it as needed. Once in its intended location, the mobile home is lifted from the transport trailer with the apparatus 10 and set back down on the ground surface. A plurality of apparatuses 10 may be used together for the lifting and lowering of the mobile home or trailer.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hydraulic jack assembly comprising:

a platform having a front side, a back side and a pair of lateral sides, a pair of vertical supports being attached to and extending upwardly from said platform;

a horizontal support being attached to said front side and extending forward thereof;

a pair of wheels, each of said vertical supports having one of said wheels rotatably coupled thereto, said wheels having a lowermost edge being positioned above a bottom side of said platform;

a lift assembly being attached to said platform;

wherein said lift assembly is abutted against and lifts a mobile home; and wherein said lift assembly includes a piston and a pump being fluidly coupled together, said piston being raised when said pump is activated, a sleeve being attached to said piston, said sleeve being raised by said piston when said piston is raised, said sleeve including a top end, a bottom end and a perimeter wall extending between said top and bottom ends, a plurality of female receivers being attached to said sleeve, said female receivers extending in a direction forward of said platform and having an open free end, said female receivers being vertically spaced from each other, and a plurality of rods, each of said rods being removably extendable into one of said female receivers, said rod being positioned under and raising the mobile home.

2. The assembly according to claim 1, wherein said plurality of female receivers including a plurality of pairs of receivers comprising a pair of horizontally aligned receivers positioned on opposite sides of said sleeve, said plurality rods including two rods positioned in said receivers of one said pairs of receivers.

3. The assembly according to claim 2, further including a brace being attached to said top end of said sleeve and being oriented perpendicular to said sleeve, said sleeve and brace forming a T-shape, said brace having a forward edge being positionable against the mobile home.

4. The assembly according to claim 1, further including a power supply being electrically coupled to said pump.

5. The assembly according to claim 4, wherein said power supply comprises at least one battery mounted on said platform.

6. The assembly according to claim 5, wherein said at least one battery is positioned adjacent to said back side, wherein said piston and said sleeve are each spaced from said back side and positioned adjacent to said front side to facilitate movement of said sleeve between said battery and said horizontal support.

7. The assembly according to claim 1, further including a release valve being fluidly coupled to said piston, said release valve preventing the lowering of said piston until said release valve has been opened.

8. The assembly according to claim 1, further including a handle being attached to said sleeve.

9. The assembly according to claim 1, further including a brace being attached to said top end of said sleeve and being oriented perpendicular to said sleeve, said sleeve and brace forming a T-shape, said brace having a forward edge being positionable against the mobile home.

10. A hydraulic jack assembly comprising:

a platform having a front side, a back side and a pair of lateral sides, a pair of vertical supports being attached to and extending upwardly from said platform;

a horizontal support being attached to said front side and extending forward thereof;

a pair of wheels, each of said vertical supports having one of said wheels rotatably coupled thereto, said wheels having a lowermost edge being positioned above a bottom side of said platform;

a lift assembly being attached to said platform, said lift assembly including;

a piston and a pump being fluidly coupled together, said piston being raised when said pump is activated;

a sleeve being attached to said piston, said sleeve being raised by said piston when said piston is raised, said sleeve including a top end, a bottom end and a perimeter wall extending between said top and bottom ends;

a plurality of female receivers being attached to said sleeve, said female receivers extending in a direction forward of said platform and having an open free end, said female receivers being vertically spaced from each other;

a plurality of rods, each of said rods being removably extendable into one of said female receivers, said plurality of female receivers including a plurality of pairs of receivers comprising a pair of horizontally aligned receivers positioned on opposite sides of said sleeve, said plurality rods including two rods positioned in said receivers of one said pairs of receivers;

a power supply being electrically coupled to said pump, said power supply comprising at least one battery mounted on said platform;

a release valve being fluidly coupled to said piston, said release valve preventing the lowering of said piston until said release valve has been opened;

a handle being attached to said sleeve;

a brace being attached to said top end of said sleeve and being oriented perpendicular to said sleeve, said sleeve and brace forming a T-shape, said brace having a forward edge;

a control being operationally coupled to said pump to raise or lower said piston; and wherein said rods are positioned in said receiver and said sleeve and forward edge of said brace are abutted against a mobile home, wherein the mobile home is then lifted by said rods when said rods are raised with said sleeve.

11. The assembly according to claim 10, wherein said at least one battery is positioned adjacent to said back side, wherein said piston and said sleeve are each spaced from said back side and positioned adjacent to said front side to facilitate movement of said sleeve between said battery and said horizontal support.

* * * * *